US012667764B1

(12) United States Patent
Li

(10) Patent No.: US 12,667,764 B1
(45) Date of Patent: Jun. 30, 2026

(54) EPP MODULAR SPLICING BASED GOLF SIMULATOR FRAMEWORK

(71) Applicant: Shanghai GEBBLO E-commerce Co.,Ltd., Shanghai (CN)

(72) Inventor: Meijiao Li, Shanghai (CN)

(73) Assignee: Shanghai GEBBLO E-commerce Co., Ltd., Shanghai (CN)

( * ) Notice: Subject to any disclaimer, the term of this patent is extended or adjusted under 35 U.S.C. 154(b) by 0 days.

(21) Appl. No.: 19/368,483

(22) Filed: Oct. 24, 2025

(51) Int. Cl.
*A63B 69/36* (2006.01)

(52) U.S. Cl.
CPC ..... *A63B 69/3623* (2013.01); *A63B 2210/50* (2013.01)

(58) Field of Classification Search
CPC ... A63B 69/3623; A63B 2210/50; E04B 1/19; E04B 2001/1993
See application file for complete search history.

(56) References Cited

U.S. PATENT DOCUMENTS 1,320,882 A * 11/1919 Maehler ..... F27D 1/004 52/223.7
2,087,958 A * 7/1937 Allen ..... E04C 2/14 192/105 CD
2,379,663 A * 7/1945 Smith ..... A63B 63/00 473/164
4,177,994 A * 12/1979 Lindquist ..... A63B 24/0021 473/156
4,250,676 A * 2/1981 Presby ..... G09F 15/0068 52/239
4,294,051 A * 10/1981 Hughes, Jr. ..... E04B 1/14 52/223.7
4,434,596 A * 3/1984 McAteer ..... E04B 2/822 52/243.1
4,538,814 A * 9/1985 Cunningham ..... A63B 69/36 473/163

(Continued)

FOREIGN PATENT DOCUMENTS

AU 2013289857 A1 * 2/2015 ..... E04B 1/3483
CN 101858154 B * 11/2012 ..... E04B 1/348

(Continued)

*Primary Examiner* — John E Simms, Jr.
*Assistant Examiner* — Amir A Klayman
(74) *Attorney, Agent, or Firm* — Hemisphere Law, PLLC

(57) ABSTRACT

The present invention discloses an EPP modular splicing based golf simulator framework which, through the core connection method of "rod insertion", enables any two module boards form a stable connection directly through steel pipes, allowing users to freely and continuously adjust the length, width, height, and depth of framework like building blocks, without using specific tools, merely by increasing or decreasing the number of standard modules and changing the insertion path of connecting rods, making it perfectly fit limited spaces, and the use of lightweight EPP material as the main structural component, along with the completely discrete design, allows the entire frame to stack and store module boards and bundle connecting rods after disassembly, greatly reducing transportation volume and weight, and enabling convenient personal handling and storage, and the standardized module design and minimalist installation process reduce the dependence on professional installers and save installation time and labor costs.

7 Claims, 5 Drawing Sheets

(56) References Cited

U.S. PATENT DOCUMENTS 4,858,922 A * 8/1989 Santavaci ..... A63B 24/0021 473/192
4,872,687 A * 10/1989 Dooley ..... A63B 24/0021 473/184
5,024,441 A * 6/1991 Rousseau ..... A63B 24/0021 473/155
5,056,791 A * 10/1991 Poillon ..... A63B 63/00 473/156
5,221,082 A * 6/1993 Curshod ..... A63B 69/36 434/252
5,390,927 A * 2/1995 Angelos ..... A63B 69/36 434/252
5,402,738 A * 4/1995 Carr ..... A47F 5/10 108/165
5,596,853 A * 1/1997 Blaney ..... E04C 2/044 52/223.7
5,846,139 A * 12/1998 Bair ..... A63B 24/0021 473/409
6,684,929 B2 * 2/2004 MacDonald ..... E04B 2/7425 52/239
6,729,085 B2 * 5/2004 Newhouse ..... B25B 5/003 52/584.1
7,544,137 B2 * 6/2009 Richardson ..... A63B 24/0021 273/317.2
7,934,693 B2 * 5/2011 Bravinski ..... E04G 11/18 249/40
8,164,830 B2 * 4/2012 Astill ..... A63B 71/0619 359/461
9,186,577 B2 * 11/2015 Weitzner ..... A63F 13/98
9,206,595 B2 * 12/2015 Rutledge ..... E04B 1/34315
9,457,499 B2 * 10/2016 Maidl ..... B29C 44/445
10,487,499 B1 * 11/2019 Berkowitz ..... E04B 2/7425
12,458,861 B2 * 11/2025 Sloan ..... A63B 71/022
2009/0061971 A1 * 3/2009 Weitzner ..... A63B 24/0021 463/2
2009/0313925 A1 * 12/2009 Lyons ..... E04B 1/34315 52/274
2011/0179722 A1 * 7/2011 Schulz ..... E04H 5/02 52/588.1
2012/0021845 A1 * 1/2012 Slavik ..... A63B 57/405 473/160
2014/0047778 A1 * 2/2014 DiGregory ..... B41F 9/063 52/79.5
2017/0223904 A1 * 8/2017 Raccanello ..... A01G 9/029
2021/0121730 A1 * 4/2021 Clark ..... A63B 21/00065

FOREIGN PATENT DOCUMENTS

CN 205242810 U * 5/2016
CN 108951850 A * 12/2018 ..... E04D 3/352
CN 109322384 A * 2/2019 ..... E04B 1/00
CN 114703961 A * 7/2022 ..... E04B 1/19
CN 117513833 A * 2/2024 ..... E04H 5/02
JP 7097133 B1 * 7/2022
KR 100698554 B1 * 3/2007 ..... A63B 71/04
KR 20110125442 A * 11/2011 ..... A63B 71/04
KR 20130056823 A * 5/2013 ..... A63B 71/04
KR 102134608 B1 * 7/2020 ..... A63B 71/022
KR 1102134608 B1 * 7/2020

* cited by examiner

EPP MODULAR SPLICING BASED GOLF SIMULATOR FRAMEWORK

TECHNICAL FIELD

The present invention relates to the field of golf simulator framework technology, specifically an EPP modular splicing based golf simulator framework.

BACKGROUND

Indoor golf simulators enable golf enthusiasts to practice and entertain in a manner that is not limited by weather and field conditions. One of their core components is a framework structure that supports projection curtains, intercepts golf balls, and has sensors and other devices, commonly known as a "striking cage". Traditional golf simulator frames pursue stability and durability, but also face a series of pain points in user experience:

1. Heavy and difficult to move: Common frames on the market are often made of metal materials, such as steel and aluminum alloys, which ensure stability but also make the entire frame very heavy and difficult to move, and the frames essentially become a semi permanent installation that limits its usage scenarios;
2. Complex installation and dependence on professional tools and personnel: Traditional assembly methods often need multiple parts, specialized tools such as screwdrivers and wrenches, as well as complex installation steps. Users often have to ask professionals for installation at their homes or spend a lot of time and effort on the instructions, resulting in high installation costs and time-consuming processes;
3. Fixed size and lack of flexibility: Most finished frames provide limited fixed sizes, such as 3 m×4 m×2.5 m, so that users cannot flexibly adjust according to their actual room size, shape, or personal preferences, which is a significant disadvantage for users with limited space or who want to customize;
4. Safety hazards: Hard metal frames may pose collision risks during high-speed swinging or personnel walking, especially for families with children or environments with relatively small spaces, which is a safety concern that cannot be ignored;

Therefore, the market is in urgent need of a lightweight, modular, easy to install, customizable in size, and safe friendly golf simulator framework solution.

SUMMARY

In view of the problems existing in the prior art, the present invention discloses an EPP modular splicing based golf simulator framework, and the technical solution adopted is that, comprising multiple discrete module boards and multiple connecting rods, the module boards are made of a lightweight cushioning material and are provided with prefabricated through-holes to allow the connecting rods to pass through, and the connecting rods sequentially pass into the corresponding through-holes on different module boards, so that the module boards are connected to form a stable three-dimensional framework structure.

As a preferred technical solution of the present invention, the module board is made of foamed polypropylene material, the corners of the module board are rounded, and the interior of the module board is provided with cavities separated by reinforcing ribs.

As a preferred technical solution of the present invention, the module board comprises a first module board for forming the top corner of the framework, a second module board for forming the top of the framework, a third module board for forming the side wall of the framework, and a fourth module board for forming the rear side of the bottom of the framework.

As a preferred technical solution of the present invention, the connecting rod is a metal tube or a high-strength composite material tube, and the outer diameter of the connecting rod forms a transition or interference fit with the diameter of the through-hole).

As a preferred technical solution of the present invention, the length, width, and height dimensions of the three-dimensional framework structure formed by the connected module boards are adjusted by increasing or decreasing the number of module boards and changing the insertion path of the connecting rods.

As a preferred technical solution of the present invention, the first module board is a right angle board, the second module board and the third module board are rectangular or cubic, the first module board, second module board and third module board are at least provided with two through-holes, the fourth module board is a right-angled triangle board, the side where the hypotenuse is located is at the inner side of the three-dimensional framework structure formed by the connected module boards, and the fourth module board is at least provided with one through-hole.

As a preferred technical solution of the present invention, fixing strip installation grooves are respectively provided on the rear side of the module board, and curtain fixing strips are fixedly installed in the fixing strip installation grooves on the module board located at the rear side of the formed three-dimensional framework, and the middle equidistant array of the curtain fixing strips is provided with curtain fixing holes for fixing the golf striking curtain.

As a preferred technical solution of the present invention, the curtain fixing strip has a U-shaped structure, and the curtain fixing hole is a long hole.

A method for building an EPP modular splicing based golf simulator framework, comprising the following steps:

Step 1: Based on the size of the golf simulator framework to be built, select multiple discrete module boards and multiple connecting rods that match, as well as golf striking curtains of corresponding sizes;

Step 2: Plan the layout path of the connecting rods between the module boards based on the sizes of target framework;

Step 3: Insert the connecting rods in sequence into the corresponding through-holes on different module boards according to the layout path, until all module boards are connected into a stable three-dimensional framework and, finally, fix the golf striking curtain on the rear side of the three-dimensional framework, thus completing the building of the golf simulator framework.

As a preferred technical solution of the present invention, the holes uniformly disposed around the edges of the golf striking curtain are connected to the curtain fixing holes through spring hooks.

The present invention has the following benefits: the present invention, through the core connection method of "rod insertion", enables any two module boards form a stable connection directly through steel pipes, allowing users to freely and continuously adjust the length, width, height, and depth of framework like building blocks, without using specific tools, merely by increasing or decreasing the number of standard modules and changing the insertion path of connecting rods, making it perfectly fit limited spaces, and the use of lightweight EPP material as the main structural component, along with the completely discrete design, allows the entire frame to stack and store module boards and bundle connecting rods after disassembly, greatly reducing transportation volume and weight, and enabling convenient personal handling and storage, and the standardized module design and minimalist installation process reduce the dependence on professional installers and save installation time and labor costs, and modular design also facilitates local replacement and maintenance in the later stage, thereby reducing the full lifecycle cost of the product.

Figure 1:
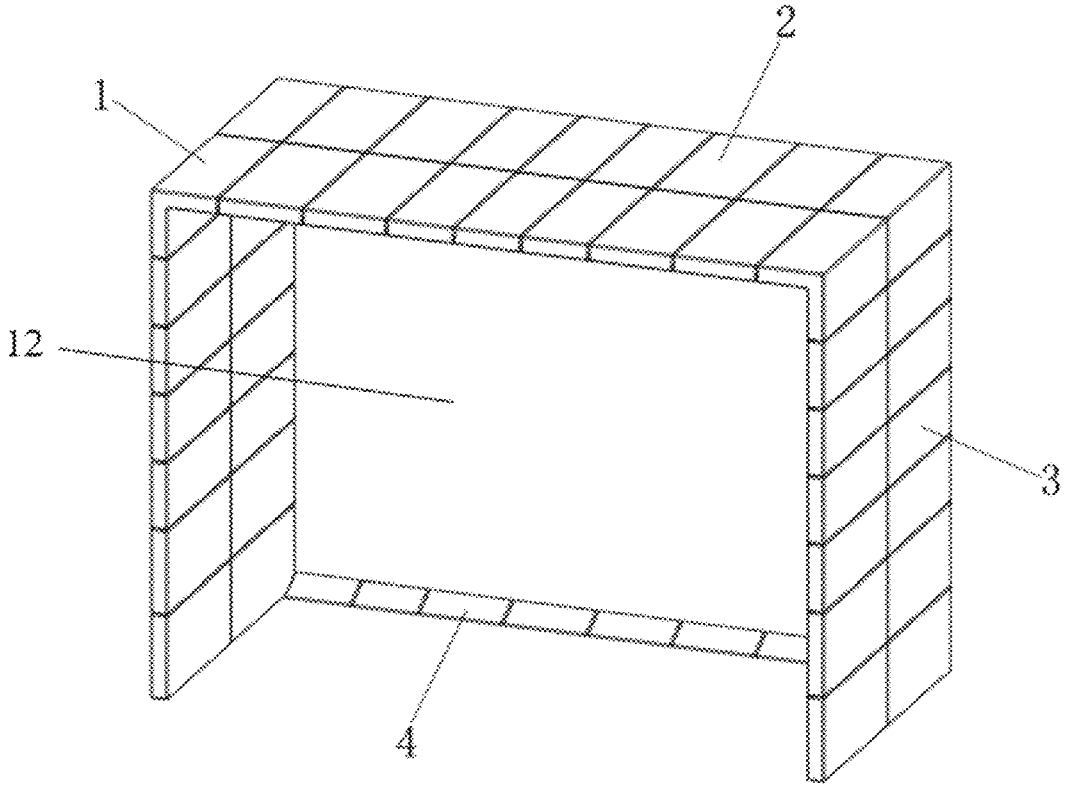
FIG. 1 is a schematic diagram of the overall structure of the present invention.

Where: 1. First module board; 2. Second module board; 3. Third module board; 4. Fourth module board; 5. Curtain fixing strip; 6. Connecting rod; 7. Through-hole; 8. Curtain fixing hole; 9. Fixing strip installation groove; 10. Cavity; 11. Reinforcing rib; 12. golf striking curtain.

DETAILED DESCRIPTION OF EMBODIMENTS

Embodiment 1

According to FIG. 1 to FIG. 8, the present invention discloses an EPP modular splicing based golf simulator framework, and the technical solution adopted is that, comprising multiple discrete module boards and multiple connecting rods 6, the module boards are made of a lightweight cushioning material, that is, foamed polypropylene material which endows the module board with the characteristics of lightweight, high strength, impact resistance, environmental protection and recyclability, and the corners of the module board are rounded to eliminate sharp corners to improve safety and aesthetics, and the interior of the module board is provided with cavities 10 separated by reinforcing ribs 11 to maximum lightweight settings while ensuring structural strength, and module boards are provided with prefabricated through-holes 7 to allow the connecting rods 6 to pass through, and the connecting rods 6 sequentially pass into the corresponding through-holes 7 on different module boards, so that the module boards are connected to form a stable three-dimensional framework structure, connecting rod 6 serves as the "skeleton" of the entire three-dimensional framework structure and after inserting through hole 7 on the module board, can connect multiple discrete and independent module boards in series to form a whole, the connecting rod 6 is a metal tube or a high-strength composite material tube, and the outer diameter of the connecting rod 6 forms a transition or interference fit with the diameter of the through-hole 7, ensuring that the steel pipe can be tightly fixed after insertion, not easily loosened, and not difficult to install due to excessive tightness. In addition, connecting rod 6 serves as the main load-bearing component to bear the tension and possible impact loads of the curtain; the length, width, and height dimensions of the three-dimensional framework structure formed by the connected module boards are adjusted by increasing or decreasing the number of module boards and changing the insertion path of the connecting rods 6; the module board comprises a first module board 1 for forming the top corner of the framework, a second module board 2 for forming the top of the framework, a third module board 3 for forming the side wall of the framework, and a fourth module board 4 for forming the rear side of the bottom of the framework; the first module board 1 is a right angle board, the second module board 2 and the third module board 3 are rectangular or cubic, the first module board 1, second module board 2 and third module board 3 are at least provided with two through-holes 7, the fourth module board 4 is a right-angled triangle board, the side where the hypotenuse is located is at the inner side of the three-dimensional framework structure formed by the connected module boards, and the fourth module board 4 is at least provided with one through-hole 7, and the relative position between each module board can be determined based on the connecting rod 6, thereby defining the final size and shape of the three-dimensional framework structure; fixing strip installation grooves 9 are respectively provided on the rear side of the module board, and curtain fixing strips 5 are fixedly installed in the fixing strip installation grooves 9 on the module board located at the rear side of the formed three-dimensional framework, and the middle equidistant array of the curtain fixing strips 5 is provided with curtain fixing holes 8 for fixing the golf striking curtain, the curtain fixing strip 5 has a U-shaped structure, and the curtain fixing hole 8 is a long hole, and the long hole is designed to allow for fine-tuning during the installation of the golf striking curtain to ensure that the golf striking curtain is tensioned flatly.

A method for building an EPP modular splicing based golf simulator framework according to claim 1, comprising the following steps:

Step 1: Based on the size of the golf simulator framework to be built, select multiple discrete module boards and multiple connecting rods 6 that match, as well as golf striking curtains of corresponding sizes;

Step 2: Plan the layout path of the connecting rods 6 between the module boards based on the sizes of target framework;

Step 3: Insert the connecting rods 6 in sequence into the corresponding through-holes 7 on different module boards according to the layout path, until all module boards are connected into a stable three-dimensional framework and, finally, fix the golf striking curtain on the rear side of the three-dimensional framework, and the holes uniformly disposed around the edges of the golf striking curtain are connected to the curtain fixing holes 8 through spring hooks, thus completing the building of golf simulator framework.

Figure 2:
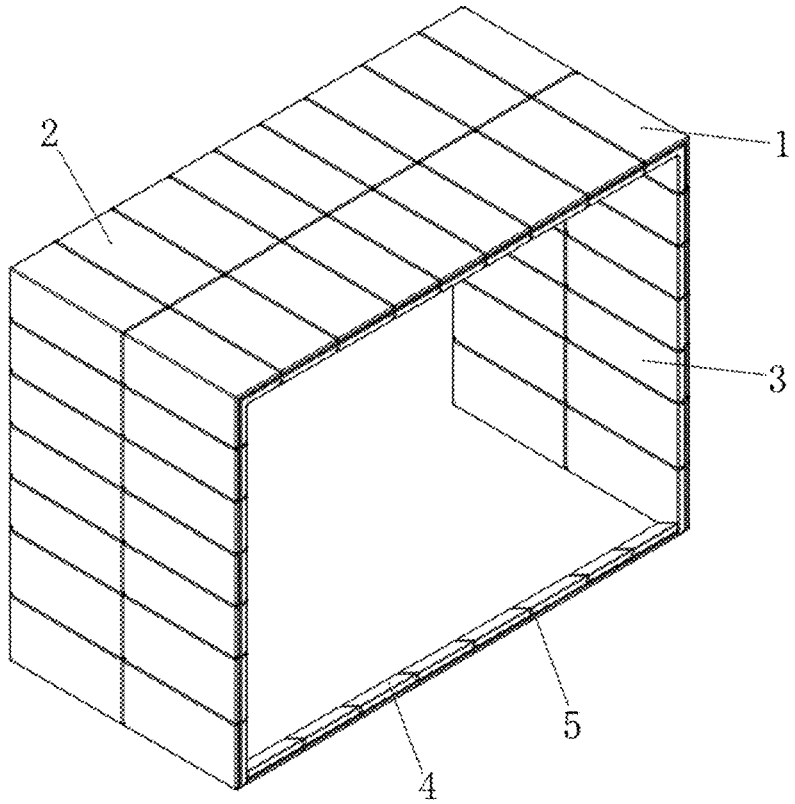
FIG. 2 is a structural diagram of the rear view of the present invention.
Figure 3:
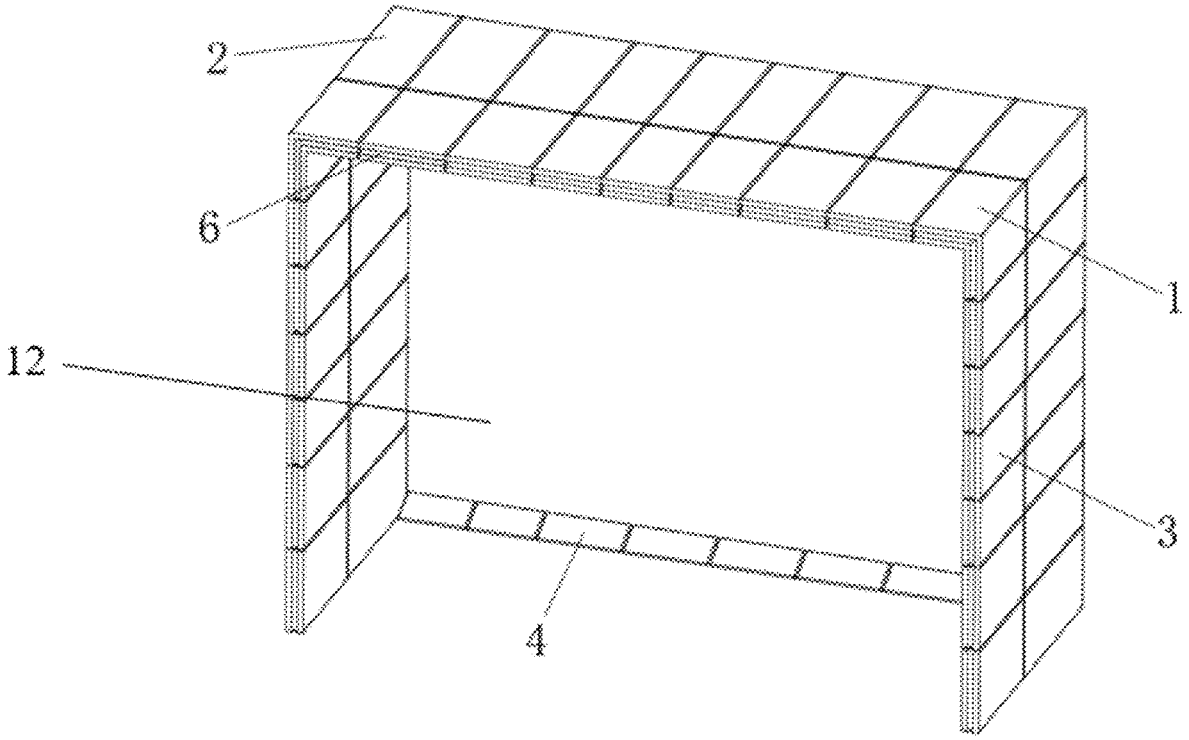
FIG. 3 is a structural diagram of a partial cross-section of the present invention.
Figure 4:
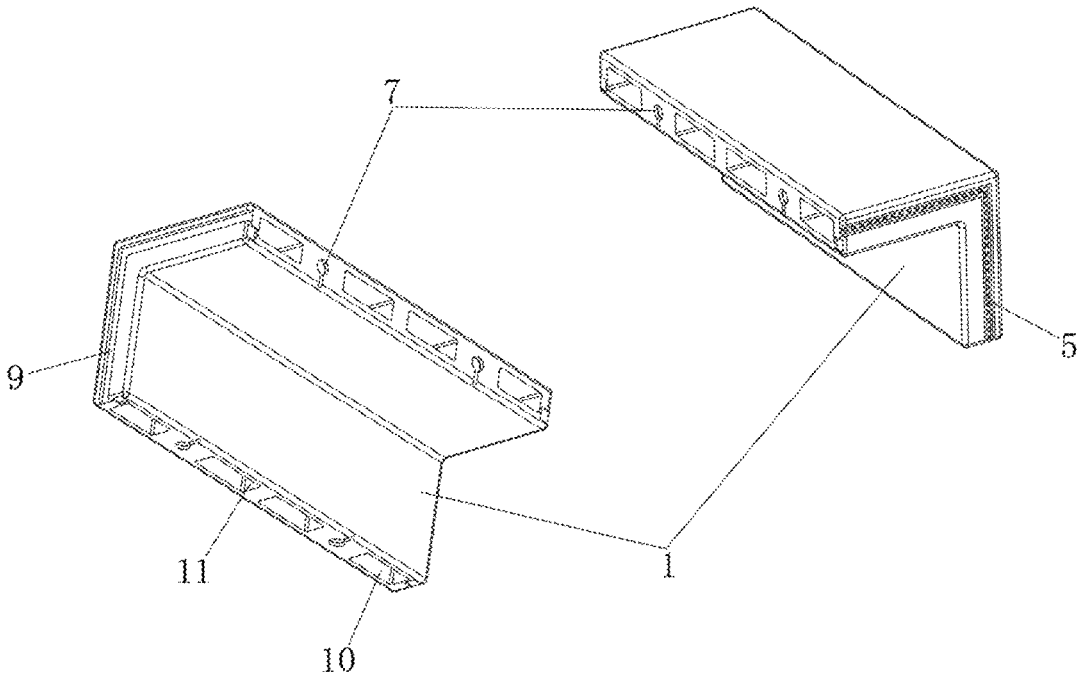
FIG. 4 is a structural diagram of the first module board of the invention.
Figure 5:
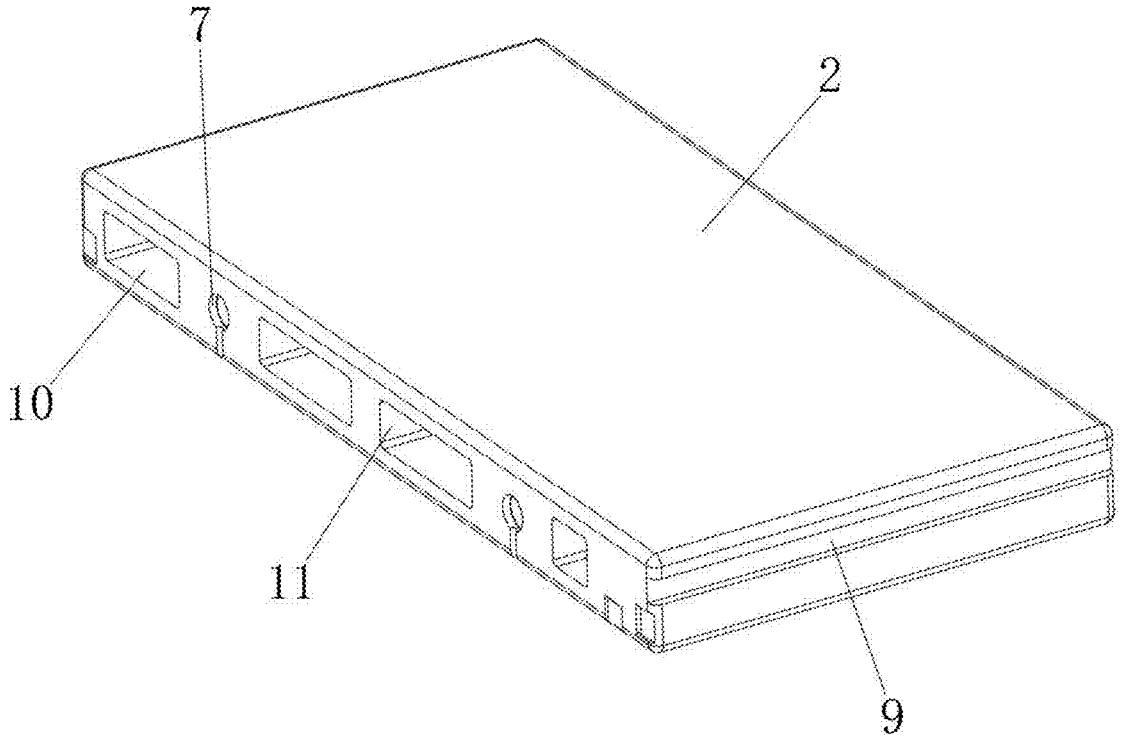
FIG. 5 is a structural diagram of the second module board of the invention.
Figure 6:
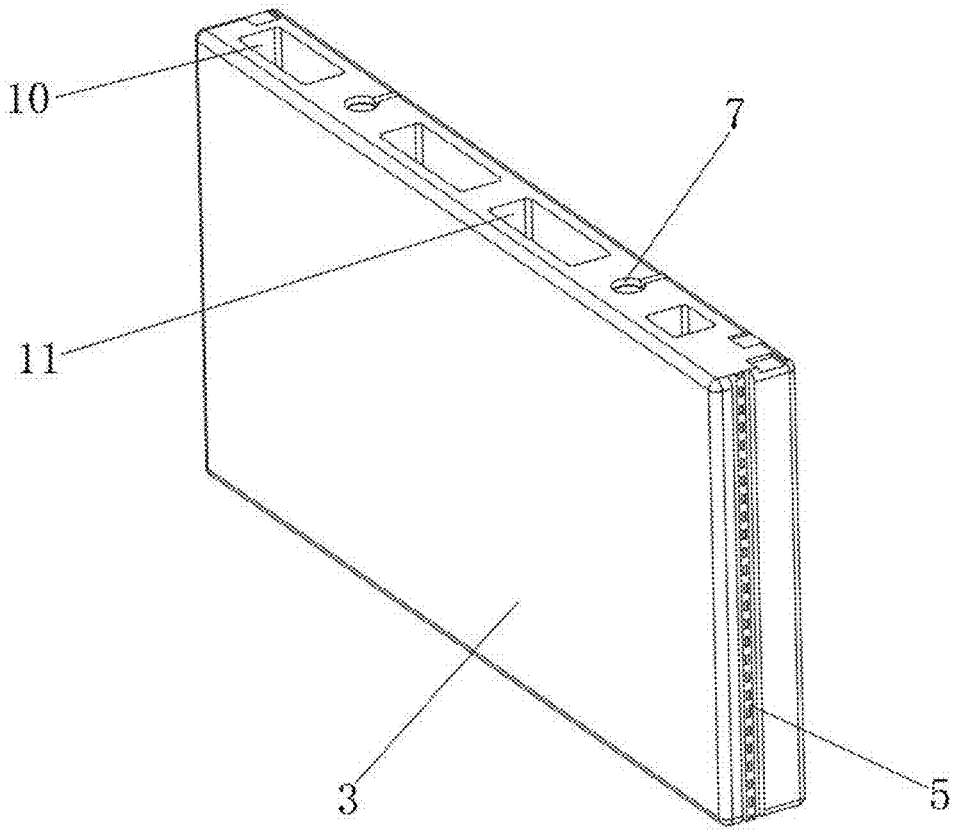
FIG. 6 is a structural diagram of the third module board of the invention.
Figure 7:
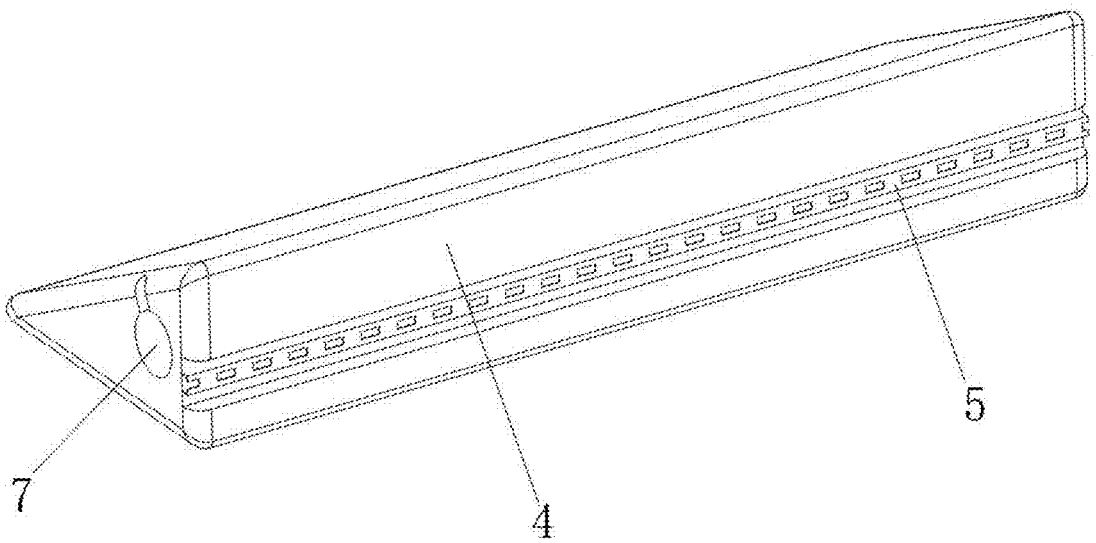
FIG. 7 is a structural diagram of the fourth module board of the present invention.
Figure 8:
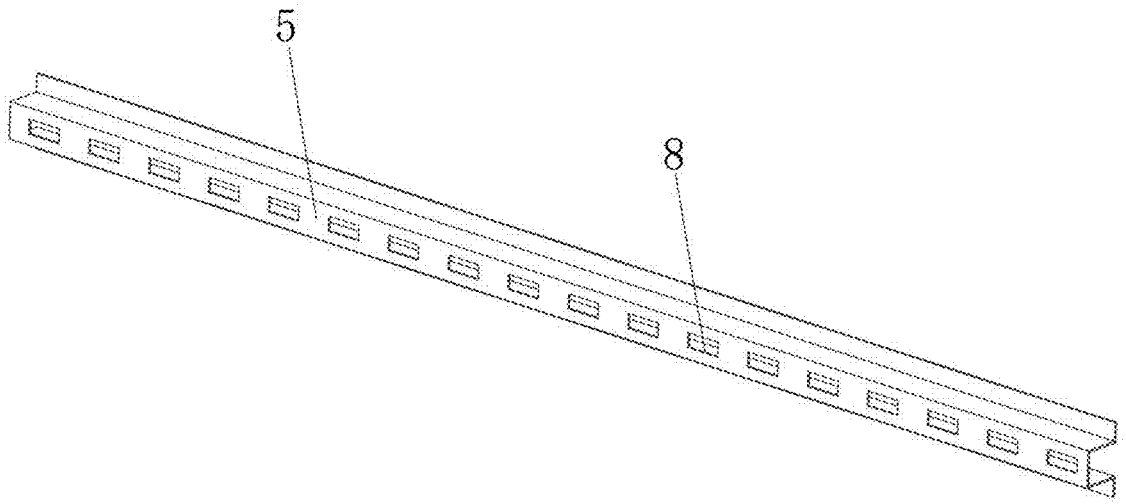
FIG. 8 is a structural diagram of the curtain fixing strip of the present invention.

Working principle of the invention: first, determine the length, width and height of the golf simulator framework to be built according to the actual space size and shape of the installation site, then plan the number of module boards and connecting rods 6 according to this size; the module board includes the first module board 1, the second module board 2, the third module board 3 and the fourth module board 4 and, at the beginning of modular splicing and assembly, take the connecting rod 6 as a "skeleton", and insert through the corresponding through-holes 7 on different module boards in turn according to the pre-planned path. The transition or interference fit between the outer diameter of connecting rod 6 and the diameter of through-hole 7 allows for a tight connection after the insertion, free from loosening, so that originally discrete module boards are firmly connected into a stable three-dimensional frame structure, as shown in FIG. 1-FIG. 3; Next, after the main structure of the framework is completed, the golf striking curtain can be connected to the curtain fixing hole 8 on the curtain fixing strip 5 through the spring hook or rope at its edge, completing curtain hanging; Finally, during use, when a golf ball hits the curtain, the impact force is transmitted to the curtain fixing strip 5 and the entire frame composed of module plates and connecting rods 6; In addition, when playing golf, there may be balls rolling on the ground, which are golf balls that roll against the ground. Due to the fact that the fourth module plate 4 is a right-angled triangular plate, and the side where its hypotenuse is located is on the inner side of the three-dimensional framework structure, the golf ball will move upward along the slope, reducing the probability of rebound; the first module board 1, second module board 2, third module board 3 and fourth module board 4 are made of foamed polypropylene material, which provides the framework with good cushioning and energy absorption and can effectively absorb part of the shock and vibration.

Components not detailed herein are from prior art.

Although the specific embodiments of the present invention have been described in detail above, the present invention is not limited to the above embodiments. Various changes can be made within the knowledge scope of the persons having ordinary skill in the art without departing from the purpose of the present invention, and modifications or variations that do not involve creative work are still within the scope of protection of the present invention.

What is claimed is:

1. An EPP modular splicing based golf simulator framework, comprising multiple discrete module boards and multiple connecting rods (6), the module boards are made of a foamed polypropylene material and are provided with prefabricated through-holes (7) to allow the connecting rods (6) to pass through, and the connecting rods (6) sequentially pass into the corresponding through-holes (7) on different module boards, so that the module boards are connected to form a stable three-dimensional golf simulator framework;

wherein an interior of each module board is provided with cavities (10) separated by reinforcing ribs (11);

wherein the module boards comprise a first module board (1) for forming a top corner of the framework, a second module board (2) for forming a top of the framework, a third module board (3) for forming a side wall of the framework, and a fourth module board (4) for forming a rear side of a bottom of the framework;

wherein the first module board (1) is a right angle board, the second module board (2) and the third module board (3) are rectangular or cubic; the first module board (1), the second module board (2) and the third module board (3) are at least provided with two through-holes (7), the fourth module board (4) is a right-angled triangle board, a side where a hypotenuse of the fourth module board (4) is located is at an inner side of the three-dimensional golf simulator framework formed by the connected module boards, and the fourth module board (4) is at least provided with one through-hole (7); and wherein fixing strip installation grooves (9) are respectively provided on rear sides of the module boards, and curtain fixing strips (5) are fixedly installed in the fixing strip installation grooves (9) on the module boards located at the rear side of the formed three-dimensional golf simulator framework, and a middle equidistant array of the curtain fixing strips (5) is provided with curtain fixing holes (8) for fixing a golf striking curtain (12).

2. The EPP modular splicing based golf simulator framework according to claim 1, wherein corners of the module boards are rounded.

3. The EPP modular splicing based golf simulator framework according to claim 1, wherein each connecting rod (6) is a metal tube or a composite material tube, and an outer diameter of each connecting rod (6) forms a transition or interference fit with the diameter of a corresponding one of through-holes (7).

4. The EPP modular splicing based golf simulator framework according to claim 1, wherein length, width, and height dimensions of the three-dimensional golf simulator framework formed by the connected module boards are adjustable by increasing or decreasing the number of module boards and changing an insertion path of the connecting rods (6) passing through the through holes (7) of different module boards.

5. The EPP modular splicing based golf simulator framework according to claim 1, wherein each curtain fixing strip (5) has a U-shaped structure.

6. A method for building an EPP modular splicing based golf simulator framework according to claim 1, comprising the following steps:

Step 1: based on a size of a golf simulator framework to be built, selecting multiple discrete module boards and multiple connecting rods (6) that match, as well as a golf striking curtains (12) of a corresponding sizes;

Step 2: planning a layout of the connecting rods (6) between the module boards based on the sizes of the golf simulator framework to be built;

Step 3: inserting the connecting rods (6) in sequence into the corresponding through-holes (7) on different module boards according to the layout, until all module boards are connected into a stable three-dimensional golf simulator framework and, finally, fixing the golf striking curtain (12) on the rear side of the three-dimensional golf simulator framework, thus completing the building of the golf simulator framework.

7. The method for building an EPP modular splicing based golf simulator framework according to claim 6, wherein holes uniformly disposed around edges of the golf striking curtain (12) are connected to the curtain fixing holes (8).

* * * * *